US010335813B2

(12) United States Patent
Wang

(10) Patent No.: US 10,335,813 B2
(45) Date of Patent: Jul. 2, 2019

(54) PUSH-TYPE NOZZLE ASSEMBLY

(71) Applicant: DERJIN (JIANGSU) PLASTIC PACKAGING CO. LTD, Jiangsu (CN)

(72) Inventor: Ya-Tsan Wang, Hsin Chu (TW)

(73) Assignee: Derjin (Jiangsu) Plastic Packaging Co. Ltd, Nantong (CN)

( * ) Notice: Subject to any disclaimer, the term of this patent is extended or adjusted under 35 U.S.C. 154(b) by 0 days.

(21) Appl. No.: 15/920,794

(22) Filed: Mar. 14, 2018

(65) Prior Publication Data

US 2018/0339305 A1 Nov. 29, 2018

(30) Foreign Application Priority Data

May 26, 2017 (CN) ..... 2017 2 0600609 U

(51) Int. Cl.
*B05B 11/00* (2006.01)

(52) U.S. Cl.
CPC ..... *B05B 11/3001* (2013.01); *B05B 11/306* (2013.01); *B05B 11/3053* (2013.01); *B05B 11/3069* (2013.01); *B05B 11/3092* (2013.01); *B05B 11/3097* (2013.01); *B05B 11/3047* (2013.01); *B05B 11/3074* (2013.01)

(58) Field of Classification Search
CPC ..... B05B 11/3001; B05B 11/3069; B05B 11/306; B05B 11/3053; B05B 11/3097; B05B 11/3092; B05B 11/3047; B05B 11/3074
See application file for complete search history.

(56) References Cited

U.S. PATENT DOCUMENTS

2010/0176158 A1* 7/2010 Carta ..... B05B 11/3023 222/321.9
2015/0251203 A1* 9/2015 Wang ..... B05B 11/3001 222/153.13
2015/0360245 A1* 12/2015 Wang ..... B05B 11/0064 239/584

* cited by examiner

*Primary Examiner* — Donnell A Long

(57) ABSTRACT

A push-type nozzle assembly includes a cylinder, a check valve, a plunger, a piston, a spring, a rotating member, a locking member, an upper push rod, a suction valve and a push head. When pushing the push head downward, and the outer chamber contact the locking member, the liquid in the cylinder is pushed out. When releasing the push head, the piston moves back by the spring to create a vacuum suction force to suck the liquid left in the nozzle back. When the outer chamber locks with the locking member, the bottom end of the piston rod seals the plunger to seal the cylinder so as to prevent leakage. When the outer chamber is separated from the locking member, the upper push rod seals the suction valve to avoid liquid from leakage. The inlet valve avoids the liquid from being accumulated in the cylinder and the top of the piston.

10 Claims, 7 Drawing Sheets

PUSH-TYPE NOZZLE ASSEMBLY

BACKGROUND OF THE INVENTION

1. Fields of the Invention

The present invention relates to a push-type nozzle assembly, and more particularly, to a push-type nozzle assembly for ejecting liquid in the bottle.

2. Description of Related Art

The conventional push-type nozzle assembly is used widely in everyday life such as body wash, lotion, shampoo, laundry detergent, cleaning detergent, and the push-type nozzle assembly is easily used by pushing the push-type nozzle assembly to get liquid from the bottle to which the push-type nozzle assembly is connected.

FIG. 1 discloses a push-type nozzle assembly 100*a* which includes a push head 101*a* which is securely connected to a bottle 102*a* so as to prevent the liquid in the bottle 102*a* from leaking from the push head 101*a*. However, when the push head 101*a* is under a pushed status, the passage 104*a* in the push head 101*a* is opened, and once the bottle 102*a* tilts, the liquid in the bottle 102*a* flows through the passage 104*a* or other gaps leaks. Furthermore, after releasing the push head 101*a*, there will be some liquid residue left in the outlet 105*a* of the push head 101*a*. The liquid residue will flow from the outlet 105*a* due to gravity. The leakage problem happens during transportation of the push-type nozzle assemblies. When the bottle 102*a* tilts, the liquid in the bottle 102*a* easily flows into the cylinder 106*a* via the air releasing holes, and is easily accumulated at the piston 103*a*. This increases risk of leakage.

The present invention intends to provide a push-type nozzle assembly that eliminates the drawbacks mentioned above.

SUMMARY OF THE INVENTION

The present invention relates to a push-type nozzle assembly and comprises a cylinder having a recess defied in the inner bottom end thereof, and an entrance is formed around the recess.

A check valve is located in the recess to open and close the entrance.

A plunger is a hollow plunger, and includes a first insertion and a second insertion, wherein the second insertion extends through the check valve and is inserted into the recess. The first insertion is located above the check valve.

A piston is a hollow piston and located in the cylinder. The piston includes a piston rod and a piston head that is integrally connected to the piston rod. The piston head is located corresponding to the first insertion. The piston head is reciprocally movable along the inner periphery of the cylinder. When the piston head moves to the first insertion, the first insertion seals the bottom end of the piston rod.

A spring is mounted to the piston rod so as to create a spring force for returning.

A rotating member is mounted to the upper portion of the cylinder and connected with a bottle.

A locking member is a hollow member and inserted into the cylinder.

An upper push rod includes an upper tube and a bottom tube which is larger than the upper tube. The bottom tube extends through the locking member. The top end of the spring is located in the bottom tube, and the bottom end of the spring is located in the inner bottom of the locking member. The upper tube is mounted to the top end of the piston rod.

A suction valve extends through the upper tube and is located in the top end of the piston rod. The top end of the suction valve is located above the upper tube.

A push head includes an inner chamber, an outer chamber and a nozzle which communicates with the inner chamber. The inner chamber includes a first locking portion formed therein. A pre-set distance is formed between the first locking portion and the top end of the inner chamber. The outer chamber has a second locking portion. The upper tube has a third locking portion formed on the outer surface thereof. The first and third locking portions are locked to each other. The locking member has a fourth locking portion formed on the outer surface thereof, and the second and fourth locking portions are locked to each other.

In one embodiment, the locking member includes a neck extending from the lower end thereof, and the neck is smaller than the locking member. An inlet valve includes an upper portion and a bottom portion which is smaller than the upper portion. The inlet valve is connected to the neck.

In one embodiment, the inlet valve includes a first ridge formed in the inner periphery thereof. The neck includes a second ridge which is engaged with the first ridge.

In one embodiment, the first insertion includes a seal ring mounted to the outside thereof, and the seal ring seals the bottom end of the piston rod.

In one embodiment, the upper tube includes an annular ring in an inner periphery thereof. The piston rod includes a first groove defined in an outer periphery of the top end thereof. The annular ring is engaged with the first groove.

In one embodiment, the suction valve includes a first-stage path, a second-stage path and a third-stage path. The first-stage path, the second-stage path and the third-stage path are integrally formed with each other. The inner diameter of the first-stage path is larger than the inner diameter of the upper tube. The inner diameter of the second-stage path is smaller than the inner diameter of the upper tube. The inner diameter of the third-stage path is smaller than the diameter of the piston rod. The third-stage path includes a restriction ridge formed on the outside thereof. The suction valve is connected to the top end of the piston rod by the restriction ridge.

In one embodiment, the first-stage path includes an annular outlet defined in the underside thereof. The upper tube includes a second groove defined in the top end thereof. The annular outlet is engaged with a wall defining the second groove.

In one embodiment, the check valve is a round valve and includes a through hole through which the second insertion extends. A receiving wall extends around the periphery of the through hole and the first insertion is engaged within the receiving wall.

In one embodiment, the check valve includes a disk and a protrusion which integrally extends from the underside of the disk. The disk includes a port through which the second insertion extends. The protrusion includes a cavity in which the second insertion is inserted.

In one embodiment, the disk of the check valve includes multiple ribs formed on the top end thereof. The disk of the check valve rested on the inner bottom of the cylinder.

The advantages of the present invention are that when pushing the push head downward to let the outer chamber contact the locking member, the liquid in the cylinder is pushed out. When releasing the push head, the piston moves back by the spring to create a vacuum suction force. Because the upper push rod and the suction valve are delayed for a period of time to be sealed, the vacuum suction force sucks the liquid left in the nozzle back. When the second locking portion of the outer chamber locks with fourth locking portion of the locking member, because the piston rod and the piston head are integral with each other, and the bottom end of the piston rod seals the plunger so that the cylinder is completely sealed, and the liquid in the bottle cannot leak from the annular outlet. When the bottle tilts, the inlet valve prevents the liquid in the bottle from flowing into the cylinder and being accumulated in the top of the piston head via the air releasing holes of the cylinder. This avoid leakage from the bottle. When the outer chamber is separated from the outer surface of the locking member, and the push head is located at its highest position, the upper push rod seals the suction valve to avoid liquid from leakage from the annular outlet.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
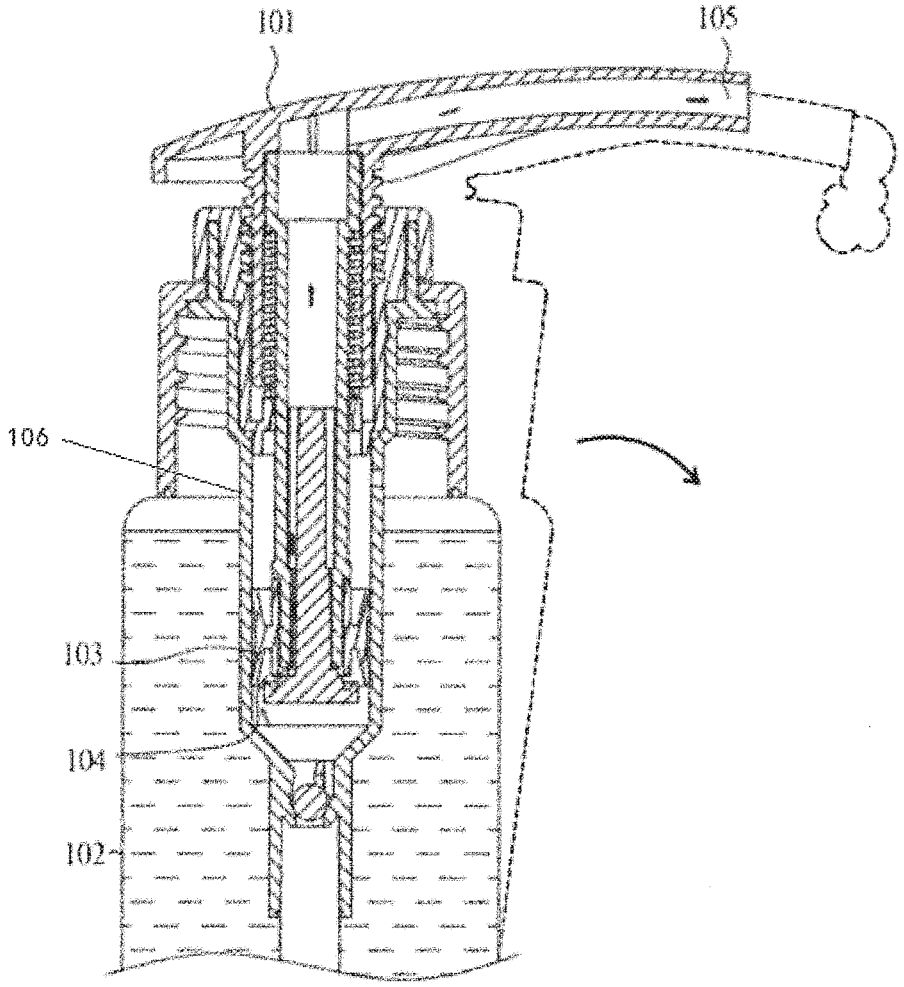
FIG.1 PRIOR ART
FIG. 1 shows the conventional push-type nozzle assembly.
Figure 2:
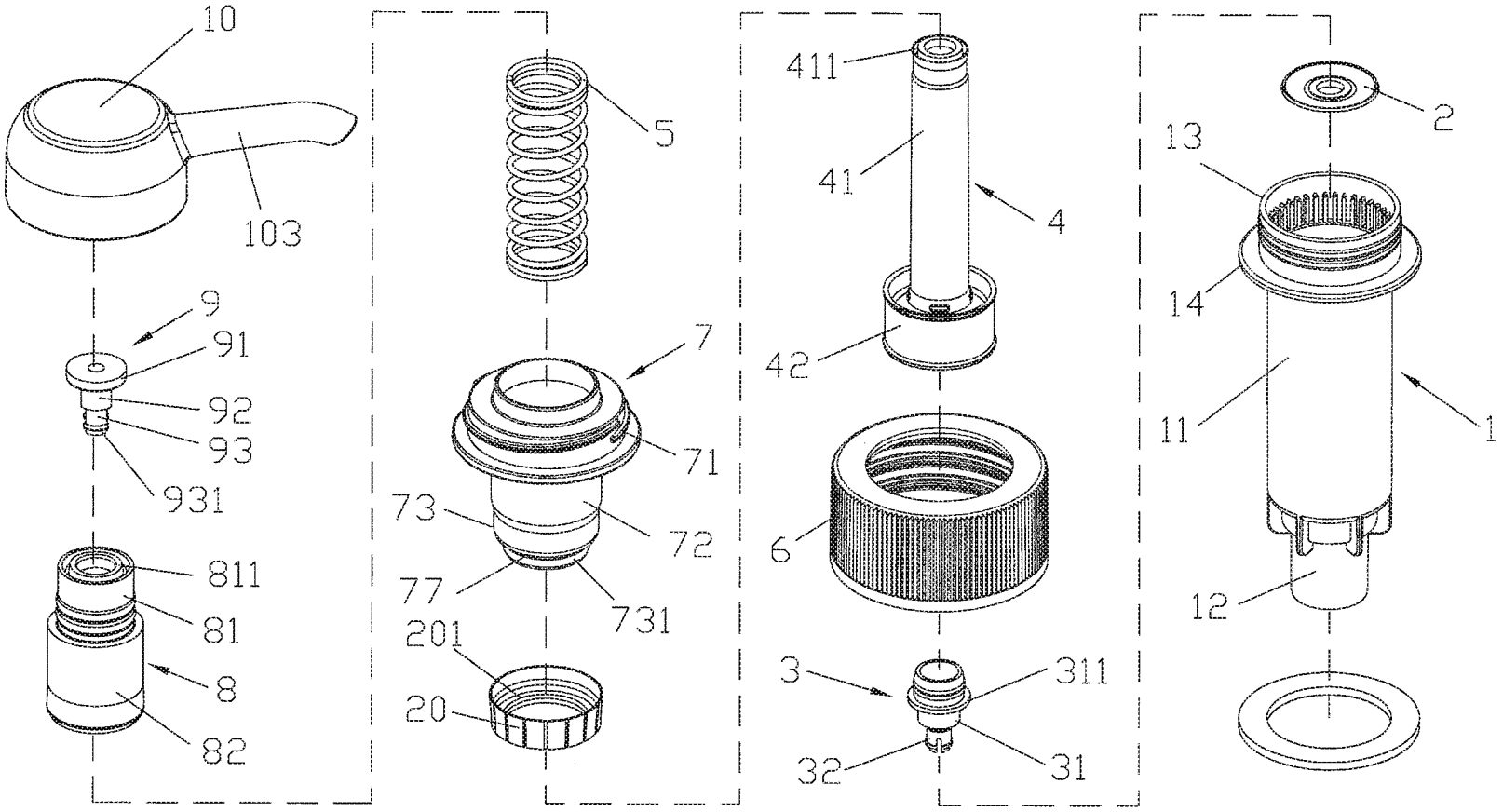
FIG. 2 is a perspective view to show the push-type nozzle assembly of the present invention.
Figure 3:
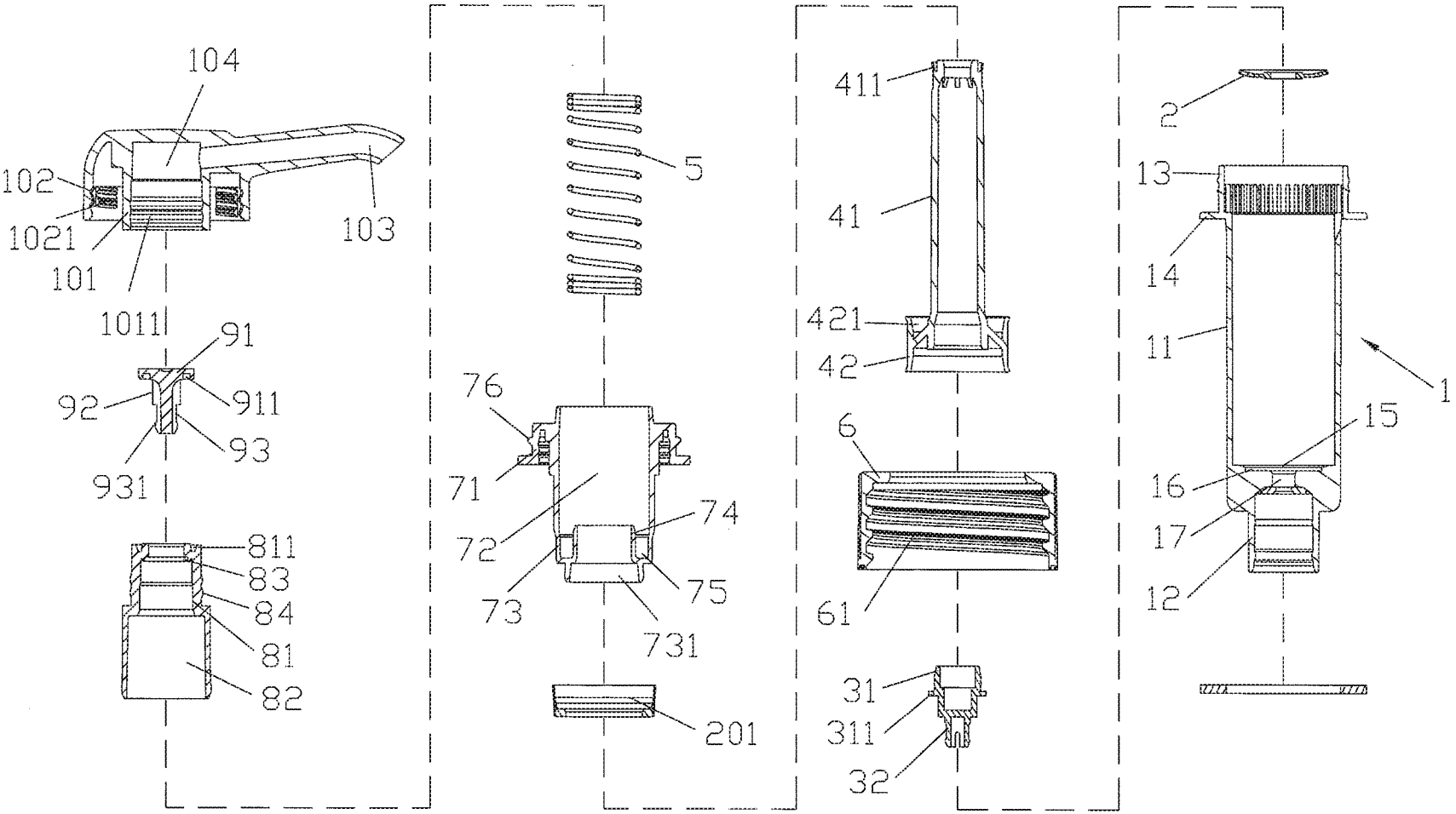
FIG. 3 is another perspective view to show the push-type nozzle assembly of the present invention.

Referring to FIGS. 2 and 3, the push-type nozzle assembly of the present invention comprises a cylinder 1, a check valve 2, a plunger 3, a piston 4, a spring 5, a rotating member 6, a locking member 7, an upper push rod 8, a suction valve 9 and a push head 10.

The cylinder 1 is a tubular cylinder and includes a body 11 and a port 12 which is smaller than the body 11. The body 11 has a connection portion 13 at the top end thereof, and the connection portion 13 has ridges extending from the outer surface thereof. A flange 14 extends from the outer surface of the connection portion 13 and located beneath the ridges. A recess 15 is defined in the inner bottom of the body 11. The port 12 located below the recess 15. The port 12 includes a larger upper section and a smaller lower section. The port 12 communicates with an open end at the lower end thereof.

The check valve 2 is located in the recess 15. An entrance 16 is formed between the check valve 2 and the recess 15. The check valve 2 controls the opening and the closing the entrance 16. In this embodiment, the check valve 2 is a round valve and matched with the recess 15.

Figure 4:
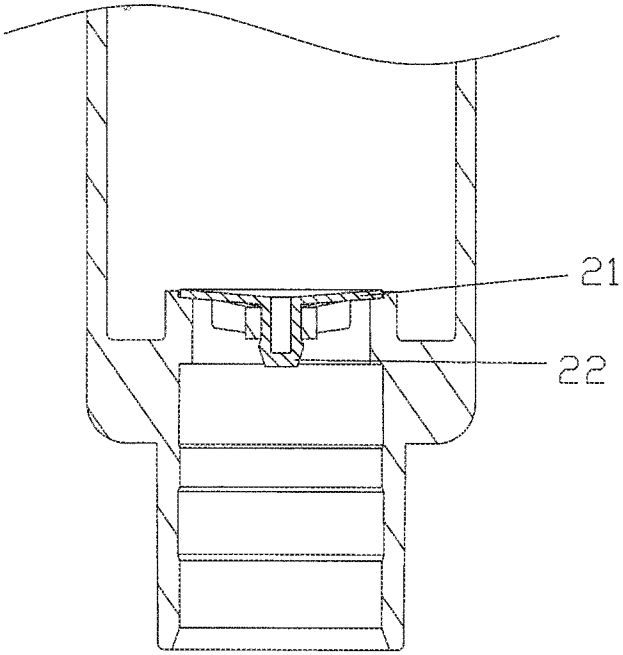
FIG. 4 shows the check valve of the push-type nozzle assembly of the present invention.

In one embodiment, the check valve 2 includes a disk 21 and a protrusion 22 which integrally extends from an underside of the disk 21. A passage 17 is formed in the bottom of the cylinder 1 and communicates with the entrance 16 that is located above the passage 17. The protrusion 22 extends through the passage 17. The disk 21 is located in the recess 15 as shown in FIG. 4.

Figure 5:
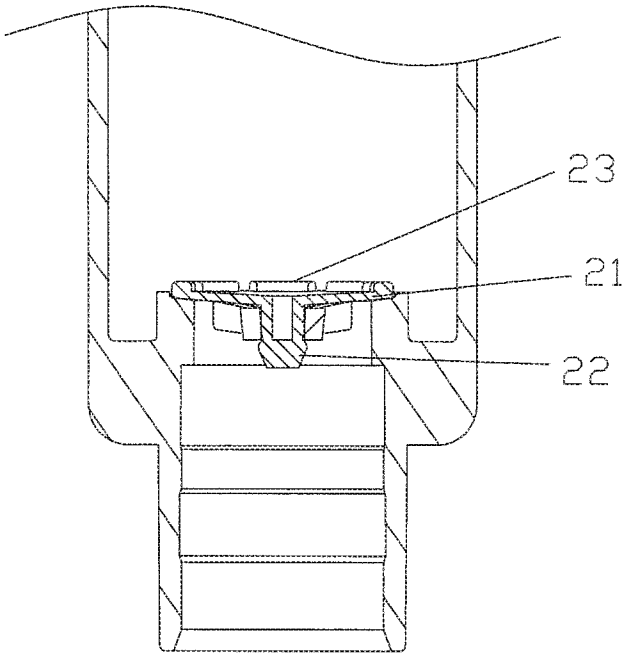
FIG. 5 shows another check valve of the push-type nozzle assembly of the present invention.

In one embodiment, in order to reinforce the sealing feature of the disk 21 of the check valve 2 to the entrance 16, the disk 21 that is located in the recess 15 of the body 11 includes multiple ribs 23 formed spaced apart from each other on the top end thereof as shown in FIG. 5.

The plunger 3 is a hollow plunger and includes a first insertion 31 and a second insertion 32. When the check valve 2 is an individual disk, the check valve 2 includes a through hole through which the second insertion 32 extends. A receiving wall extends around the periphery of the through hole and the first insertion 31 is engaged within the receiving wall. The second insertion 32 extends through the check valve 2 and inserted into the passage 17. The check valve 2 includes a disk 21 and a protrusion 22 which integrally extends from the underside of the disk 21, the disk 21 includes a port through which the second insertion 32 extends, and the protrusion 22 includes a cavity in which the second insertion 32 is inserted. The second insertion 32 extends through the check valve 2 and inserted into the cavity.

The piston 4 is a hollow piston and located in the body 11. The piston 4 includes a piston rod 41 and a piston head 42 that is integrally connected to the piston rod 41. The piston head 42 is located corresponding to the first insertion 31. The piston head 42 is reciprocally movable along the inner periphery of the body 11. When the piston head 42 moves to the first insertion 31, the first insertion 31 is inserted into and seals the bottom end of the piston rod 41. Furthermore, in order to provide a better sealing feature between the first insertion 31 and the piston rod 41, the first insertion 31 includes a seal ring 311 mounted to the outside thereof. When the bottom end of the piston rod 41 is mounted to the first insertion 31, the seal ring 311 seals the bottom end of the piston rod 41.

The spring 5 is mounted to the piston rod 41 so as to create a spring force to return the piston rod 41.

The rotating member 6 has a through passage and is mounted to the upper portion of the body 11 and rested on the flange 14. The rotating member 6 includes inner threads 61 so as to be connected with a bottle.

The locking member 7 is a hollow member and includes a mounting portion 71 and a tubular part 72, wherein the mounting portion 71 is mounted to the connection portion 13 of the cylinder 1, and the tubular part 72 is located in the body 11. The mounting portion 71 includes inner ridges on the inside thereof so as to be threadedly connected to the ridges of the connection portion 13. The tubular part 72 includes a neck 73 which includes an upper wider portion and a narrow lower portion. The neck 73 includes an inner tube 74 located therein which is connected to the piston rod 41. There is a room 75 between the inner tube 74 and the inside of the neck 73. The bottom end of the spring 5 is located in the room 75. The piston head 42 includes a restriction portion 421 on the top edge thereof, and the neck 73 has a stop 731 on the bottom edge thereof. When the piston 4 moves upward by the spring 5, and the restriction portion 421 contacts the inlet valve 20 to restrict continuous movement of the piston 4.

The upper push rod 8 is a hollow tube and has an upper tube 81 and a bottom tube 82 which is larger than the upper tube 81. The bottom tube 82 extends into the tubular part 72. The top end of the spring 5 is located in the bottom tube 82, and the bottom end of the spring 5 is located in an inner bottom of the locking member 7. The spring 5 is restricted between the bottom tube 82 and the room 75. The upper tube 81 is mounted to the top end of the piston rod 41. In order to allow the upper push rod 8 to drive the piston rod 41 to move downward, the upper tube 81 includes an annular ring 83 in the inner periphery thereof. The piston rod 41 includes a first groove 411 defined in an outer periphery of the top end thereof. When the upper push rod 8 moves downward, the annular ring 83 is engaged with the first groove 411 so as to drive the piston rod 41 downward.

The suction valve 9 includes a first-stage path 91, a second-stage path 92 and a third-stage path 93. The first-stage path 91, the second-stage path 92 and the third-stage path 93 are integrally formed with each other. The inner diameter of the first-stage path 91 is larger than the inner diameter of the upper tube 81. The inner diameter of the second-stage path 92 is smaller than the inner diameter of the upper tube 81. The inner diameter of the third-stage path 93 is smaller than the diameter of the piston rod 41. The third-stage path 93 includes a restriction ridge 931 formed on the outside thereof. The suction valve 9 is connected to the top end of the piston rod 41 by the restriction ridge 931. The second-stage path 92 is located in the upper tube 81. The first-stage path 91 is located above the upper tube 81. The third-stage path 93 uses the restriction ridge 931 to contact the top end of the piston rod 41. The upper tube 81 moves up and down in the second-stage path 92.

The first-stage path 91 includes an annular outlet 911 defined in the underside thereof. The upper tube 81 includes a second groove 811 defined in the top end thereof. The annular outlet 911 is engaged with the wall defining the second groove 811. The upper tube 81 moves upward by the spring 5, the annular outlet 911 is engaged with the wall defining the second groove 811, the suction valve 9 is shut off. On the contrary, when the upper tube 81 moves downward by the spring 5, the annular outlet 911 is disengaged from the wall defining the second groove 811, the suction valve 9 is opened.

The push head 10 includes an inner chamber 101, an outer chamber 102 and a nozzle 103 which communicates with the inner chamber 101. The inner chamber 101 includes a first locking portion 1011 formed therein. A pre-set distance is formed between the first locking portion 1011 and the top end of the inner chamber 101. The outer chamber 102 has a second locking portion 1021. The upper tube 81 has a third locking portion 84 formed on the outer surface thereof. The first and third locking portions 1011, 84 are locked to each other. The locking member 7 has a fourth locking portion 76 formed on the outer surface thereof. The second and fourth locking portions 1021, 76 are locked to each other.

The push head 10 is locked with the upper push rod 8 by the connection between the first and third locking portions 1011, 84. In the meanwhile, there is a space 104 formed between the top end of the upper push rod 8 and the top of the inner chamber 101.

In order to prevent the liquid in the bottle leaks from the air releasing holes and flows into the body 11 and being accumulated at the top end of the piston head 42, the push-type nozzle assembly includes an inlet valve 20 which is connected to the neck 73 of the locking member 7. Specifically, the inlet valve 20 includes a first ridge 201 formed in the inner periphery thereof, and the neck 73 includes a second ridge 77 which is threadedly engaged with the first ridge 201.

Figure 6:
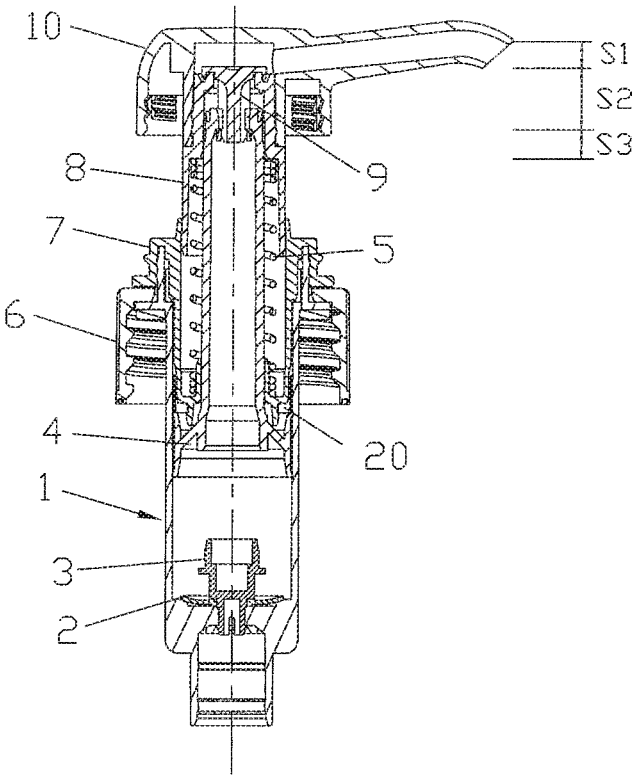
FIG. 6 is a cross sectional view to show the push-type nozzle assembly of the present invention.
Figure 7:
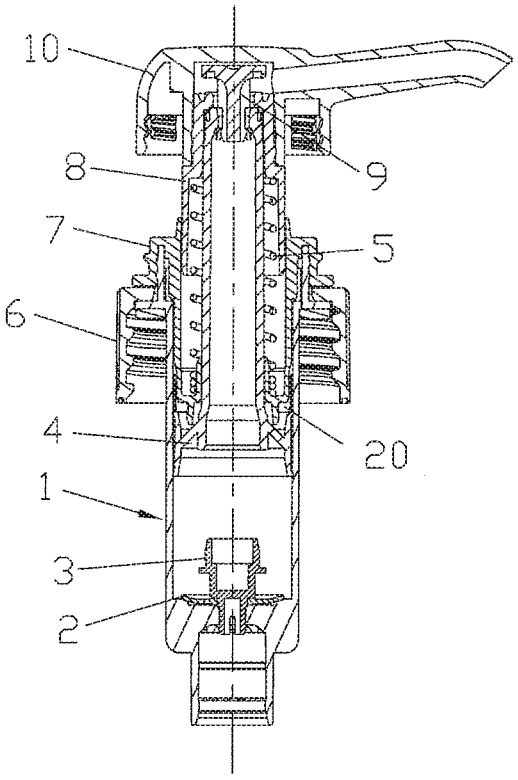
FIG. 7 is a cross sectional view to show that the push head of the push-type nozzle assembly of the present invention is pushed.
Figure 8:
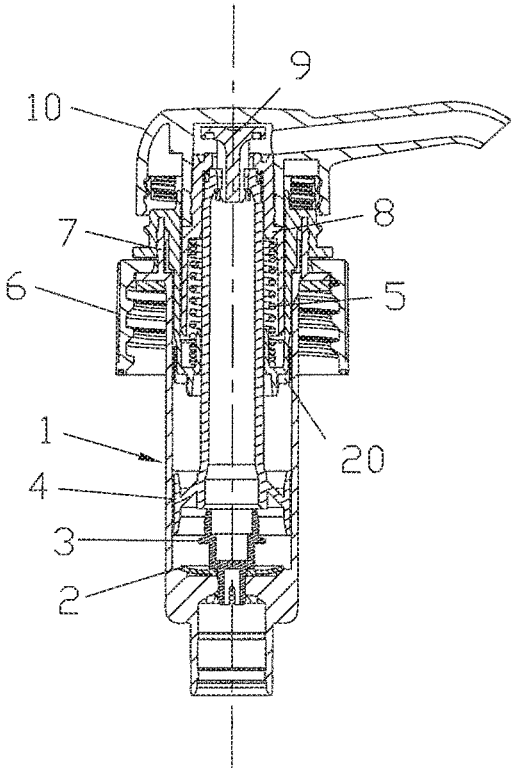
FIG. 8 is a cross sectional view to show that the push head of the push-type nozzle assembly of the present invention is pushed to allow liquid to be ejected out.

When in use, the push head 10 is pushed to move the upper push rod 8 downward. In the travel S1 of the space 104, the piston head 42 is stationary due to friction with the inner wall of the body 11, so that the piston rod 41 does not move, and the annular outlet 911 is gradually opened. When the travel S1 finishes, the annular outlet 911 is completely opened. The push head 10 is continuously pushed, the annular ring 83 is engaged with the firs groove 411, and the push head 10 drives the upper push rod 8, the piston rod 41 and the suction valve 9 downward, until the outer chamber 102 contacts the mounting portion 71. When the travel S2 is finished, during this travel, the piston head 42 compresses the interior space of the body 11. The check valve 2 seals the entrance 16 due to change of pressure, so that the liquid in the body 11 flows into the piston rod 41 and then flows to the nozzle 103 via the annular outlet 911. The liquid eventually is ejected from the nozzle 103 as shown in FIGS. 6 to 8.

When releasing the push head 10, the upper push rod 8 moves upward by the spring 5, and the piston rod 41 and the piston head 42 are stationary due to friction with the inner wall of the body 11. The annular outlet 911 is gradually closed. The push head 10 is continuously moved upward by the upper push rod 8, and the upper push rod 8 drives the suction valve 9 and the piston rod 41 upward. The liquid in the bottle is affected by the vacuum suction force and starts to flow through the port 12 of the cylinder 1. The liquid pushes the check valve 2 and opens the entrance 16 and enters into the lower portion of the body 11, until the restriction portion 421 of the piston head 42 contacts the inlet valve 20, to return to its initial position and ready for next pushing.

When the push head 10 is released, the upper push rod 8 moves upward by the spring 5, so that the piston rod 41 and the piston head 42 are stationary due to friction with the inner wall of the body 11. The annular outlet 911 is gradually closed. A vacuum suction force is formed in the space 104 so as to suck the liquid left in the nozzle 103. Therefore, the liquid will drip from the nozzle 103 due to gravity.

Figure 9:
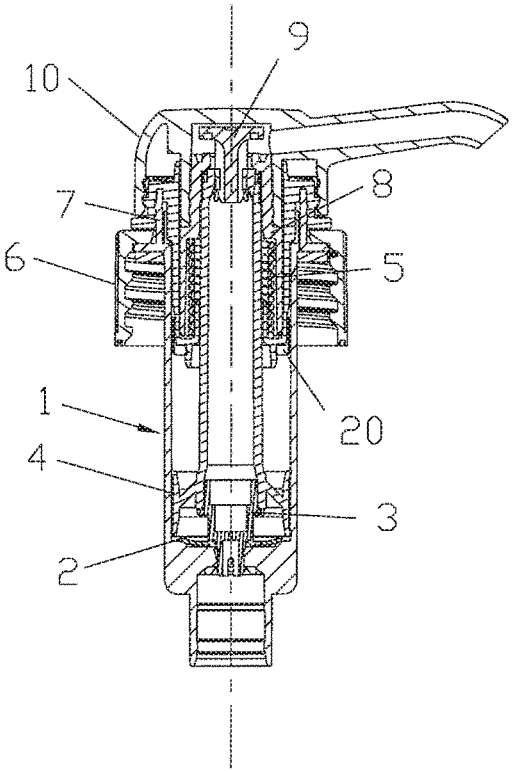
FIG. 9 is a cross sectional view to show that the push head of the push-type nozzle assembly of the present invention is locked.

When pushing the push head 10 and complete the travels S1 and S2, the push head 10 continues to move downward of the travel S3. The second locking portion 1021 of the outer chamber 102 is locked with the fourth locking portion 76 of the mounting portion 71. The piston rod 41 is sealed with the first insertion 31, so that the area below the piston head 42 in the body 11 is sealed. Even when the bottle tilts, the liquid in the bottle cannot not leak from the entrance 16 of the cylinder 1 as shown in FIG. 9.

When no force is applied to the push head 10, the annular outlet 911 is engaged with the wall defining the second groove 811 due to the spring 5, so that even when the bottle tilts or receives a force applied thereto, the liquid in the bottle cannot leak from the annular outlet 911 of the suction valve 9.

While we have shown and described the embodiment in accordance with the present invention, it should be clear to those skilled in the art that further embodiments may be made without departing from the scope of the present invention.

What is claimed is:

1. A push-type nozzle assembly comprising:

a cylinder being a tubular cylinder and having a recess and a passage formed in a bottom thereof;

a check valve located in the recess, an entrance formed between the check valve and the recess, the check valve capable of opening and closing the entrance;

a plunger being a hollow plunger and having a first insertion and a second insertion, the second insertion extending through the passage via the check valve, the first insertion located above the check valve;

a piston being a hollow piston and located in the cylinder, the piston including a piston rod and a piston head that is integrally connected to the piston rod, the piston head located corresponding to the first insertion, the piston head being reciprocally movable along an inner periphery of the cylinder, when the piston head moves to the first insertion, the first insertion seals a bottom end of the piston rod;

a spring mounted to the piston rod so as to create a spring force;

a rotating member mounted to an upper portion of the cylinder and adapted to be connected with a bottle;

a locking member being a hollow member and inserted into the cylinder;

an upper push rod having an upper tube and a bottom tube which is larger than the upper tube, the bottom tube extending through the locking member, a top end of the spring located in the bottom tube, a bottom end of the spring located in an inner bottom of the locking member, the upper tube mounted to a top end of the piston rod;

a suction valve extending through the upper tube and located in the top end of the piston rod, a top end of the suction valve located above the upper tube, and a push head including an inner chamber, an outer chamber and a nozzle which communicates with the inner chamber, the inner chamber including a first locking portion formed therein, a preset distance formed between the first locking portion aid a top end of the inner chamber, the outer chamber having a second locking portion, the upper tube having a third locking portion formed on an outer surface thereof, the first and third locking portions being locked to each other, the locking member having a fourth locking portion formed on an outer surface thereof, the second and fourth locking portions being locked to each other.

2. The push-type nozzle assembly as claimed in claim 1, wherein the locking member includes a neck extending from a lower end thereof, the neck is smaller than the locking member, an inlet valve includes an upper portion and a bottom portion which is smaller than the upper portion, the inlet valve is connected to the neck.

3. The push-type nozzle assembly as claimed in claim 2, wherein the inlet valve includes a first ridge formed in an inner periphery thereof, the neck includes a second ridge which is engaged with the first ridge.

4. The push-type nozzle assembly as claimed in claim 1, wherein the first insertion includes a seal ring mounted to an outside thereof, the seal ring seals the bottom end of the piston rod.

5. The push-type nozzle assembly as claimed in claim 1, wherein the upper tube includes an annular ring in an inner periphery thereof, the piston rod includes a first groove defined in an outer periphery of the top end thereof, the annular ring is engaged with the first groove.

6. The push-type nozzle assembly as claimed in claim 1, wherein the suction valve includes a first-stage path, a second-stage path and a third-stage path, the first-stage path, the second-stage path and the third-stage path are integrally formed with each other, an inner diameter of the first-stage path is larger than an inner diameter of the upper tube, an inner diameter of the second-stage path is smaller than the inner diameter of the upper tube, an inner diameter of the third-stage path is smaller than a diameter of the piston rod, the third-stage path includes a restriction ridge formed on an outside thereof, the suction valve is connected to the top end of the piston rod by the restriction ridge.

7. The push-type nozzle assembly as claimed in claim 6, wherein the first-stage path includes an annular outlet defined in an underside thereof, the upper tube includes a second groove defined in a top end thereof, the annular outlet is engaged with a wall defining the second groove.

8. The push-type nozzle assembly as claimed in claim 1, wherein the check valve is a round valve and includes a through hole through which the second insertion extends, a receiving wall extends around a periphery of the through hole and the first insertion is engaged within the receiving wall.

9. The push-type nozzle assembly as claimed in claim 1, wherein the check valve includes a disk and a protrusion which integrally extends from an underside of the disk, the disk includes a port through which the second insertion extends, the protrusion includes a cavity in which the second insertion is inserted.

10. The push-type nozzle assembly as claimed in claim 9, wherein the disk of the check valve includes multiple ribs formed on a top end thereof, the disk of the check valve rested in the recess of the body of the cylinder.

* * * * *